United States Patent [19]

Redding

[11] Patent Number: 4,984,836

[45] Date of Patent: Jan. 15, 1991

[54] REMOTE AREA GOLF BALL RETRIEVER

[76] Inventor: Warren E. Redding, 14918 Scarlet Oak La., Tomball, Tex. 77375

[21] Appl. No.: 333,293

[22] Filed: Apr. 4, 1989

[51] Int. Cl.[5] ..... A63B 47/02

[52] U.S. Cl. ..... 294/66.1; 294/19.2; 414/440

[58] Field of Search ..... 294/19.2, 66.1; 56/328.1, 332, 400.01, 400.02, 400.03, 400.13; 171/58, 63; 414/437, 439, 440

[56] References Cited

U.S. PATENT DOCUMENTS

| | | | |
|---|---|---|---|
| 2,365,540 | 12/1944 | Fonken | 414/440 |
| 2,605,129 | 7/1952 | Rooker | 294/66.1 |
| 2,812,871 | 11/1957 | Woodall | 414/440 |
| 3,306,480 | 2/1967 | Wysong | 414/440 |
| 3,744,225 | 7/1973 | Reeves | 56/328.1 |
| 3,788,506 | 1/1974 | Lee | 414/440 |
| 4,077,194 | 3/1978 | Livingston | 414/440 X |
| 4,593,519 | 6/1986 | Kimball | 414/440 X |
| 4,645,254 | 2/1987 | Warden | 294/19.2 |
| 4,669,770 | 2/1987 | Spielman et al. | 294/19.2 |

OTHER PUBLICATIONS

May 1989, Golf Digest, p. 183, Outdoor Supply Co.

*Primary Examiner*—Johnny D. Cherry
*Attorney, Agent, or Firm*—Vaden, Eickenroht, Thompson & Boulware

[57] ABSTRACT

A rugged self-contained tool for performing golf ball retrieval from remote and otherwise inaccessible areas of a water hazard comprising a plurality of rigidly mounted, ball-pinching, spaced, resilient discs upon an axle supported rotatably by and between the ends of a one-half rectangular cooperating ball-confining frame. The tool can be deployed by casting same into remote or otherwise inaccessible areas retaining control thereof by means of a cord attached to an eyelet centrally located on the frame, which cord, when pulled steadily, rolls the tool upon the bottom of the water hazard returning the tool and its retained contents to the user. The frame of the tool provides hydroplaning downward pressure on the tool and the discs have multiple straight sides at their outer peripheries to provide traction with the bottom.

3 Claims, 1 Drawing Sheet

REMOTE AREA GOLF BALL RETRIEVER

BACKGROUND OF THE INVENTION

1. Field of the Invention

This invention relates to underwater golf ball retrieving tools, especially for use in retrieving balls in remote and otherwise inaccessible areas.

2. Description of the Prior Art

Heretofore, individual user underwater golf ball retrieving tools had a limited reach of twenty (20) feet and required attachment to a handle. This undesirable limiting feature suggests that a means is needed to extend the reach of such tools.

Due to the buoyancy of the golf ball, the construction of current-type retrievers requires delicate manipulation to avoid striking the ball too sharply, thus deflecting said ball away from the tool's retainer This unsatisfactory relationship between retriever and ball points to a need to confine the ball inescapably in the area immediately ahead of the retaining means.

Another undesirable feature of state of the art retrievers is the inability to place the retrieving tool in remote and otherwise inaccessible areas, i.e., near an island, sheer opposite bank or other obstruction that would prevent physical access to the opposite side of the water hazard. Thus, a tool and a means for deploying that tool that will efficiently operate are needed.

Most golfers, therefore, would find it desirable to have a tool requiring no special dexterity or manipulative skill to accomplish the herein described ends.

Therefore, it is an object of this invention to provide an improved golf ball retriever for retrieving golf balls from a water hazard that utilizes a plurality of rolling, ball-pinching discs within a cooperating frame suitable for being deployed into a water hazard by casting by means of a cord centrally attached to the frame, the frame being designed to provide down pressure by hydroplaning action when the cord is drawn through the water and the discs each having multiple flat-sided peripheries for providing traction with the bottom of the water hazard.

It is another object of this invention to provide such an improved golf ball retriever that is rugged and easily adaptable for being carried in a golfer's bag.

SUMMARY OF THE INVENTION

The inventive golf ball retrieving apparatus for retrieving golf balls from a water hazard generally comprises a strap frame that is shaped in the form of one-half of a rectangle, an axle connected through orifices in the opposite parallel ends of the frame, a plurality of resilient, ball-pinching discs rigidly secured to the axle and spaced from each other at successive distances slightly less than the diameter of a golf ball, and means for pulling the apparatus by its frame through the water hazard. As the apparatus is pulled, the frame causes downward pressure on the apparatus. The means for pulling the apparatus is preferably a cord attached at a center position on the frame. Each of the discs includes a periphery with multiple straight sides, preferably being octagon shaped, so as to provide traction with the bottom of the water hazard as the discs roll therealong during the pulling action. The preferred distance between the frame and the peripheries of the discs is one-third of a golf ball. Such spacing helps secure the balls firmly in their retained positions without blocking axle rotation or dislodging the balls.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the exemplary preferred embodiment thereof which is illustrated in the drawings, which form a part of this specification. It is to be noted, however, that the appended drawings illustrate only a typical preferred embodiment of the invention and are not to be considered limiting of its scope as the invention may admit to other equally effective embodiments.

In the drawings.

DESCRIPTION OF THE PREFERRED EMBODIMENT

Figure 1:
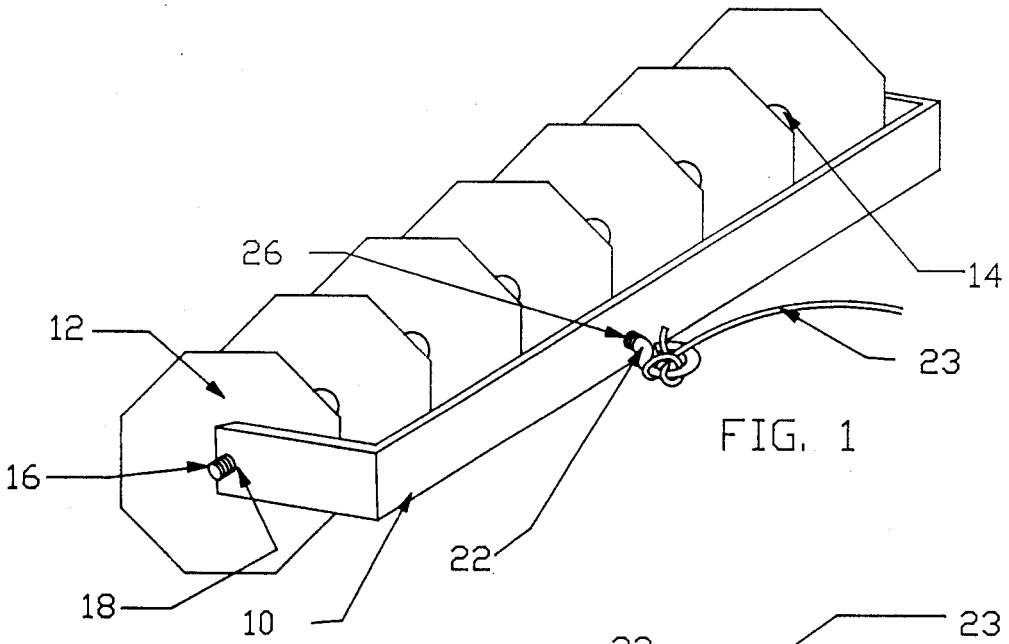
FIG. 1 is an orthographic projection of the ball retrieving assembly comprising this invention proportionally scaled.

Now referring to the drawings and first to FIG. 1, frame 10 comprises a one-piece strap metal of one-half rectangular or U-shape configuration having two orifices 18 providing a spaced relationship of approximately one-third the diameter of a golf ball between the outer edges of the discs 12 and the adjacent inside of frame 10. One orifice 18 is in each of the parallel ends of the frame to receive axle 16. One hole 26 is centered on the strap half-way between its parallel ends to receive an eyebolt 22.

Figure 2:
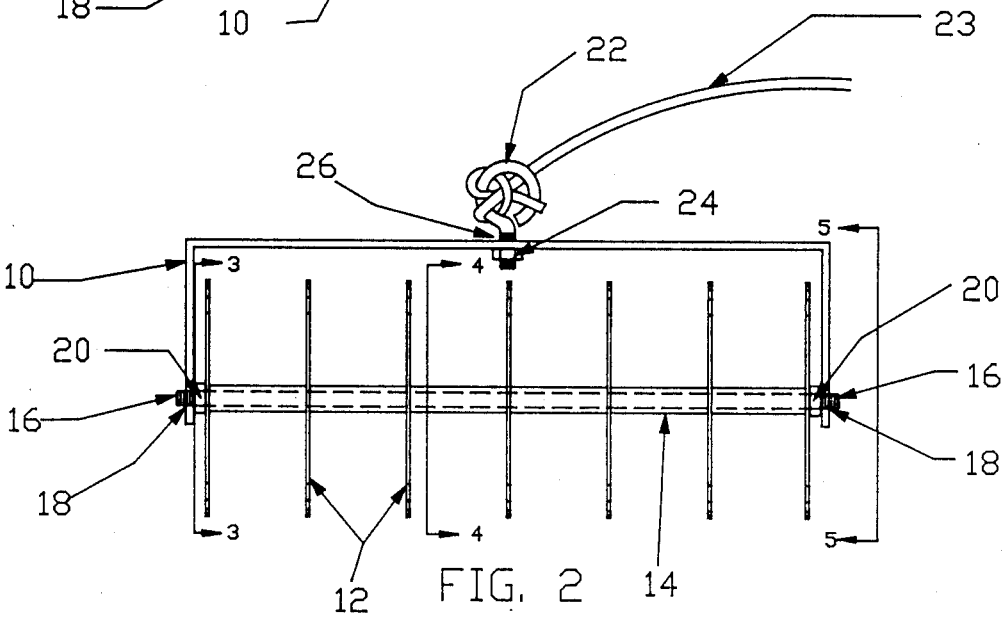
FIG. 2 is an assembled proportionally scaled face view of this invention.

Axle 16 and the overall assembly is shown in the front or face view of FIG. 2. The assembly comprises a plurality of resilient metallic discs 12 separated by equidistant tubular spacers 12 at a distance slightly less than the diameter of a golf ball to cause the lodgement of golf balls between any pair of the discs. All of these parts are compressed and locked rigidly together on threaded axle 16 by nuts 20. The protruding ends of axle 16 extend through orifices 18 provided through the ends of frame 10.

Figure 3:
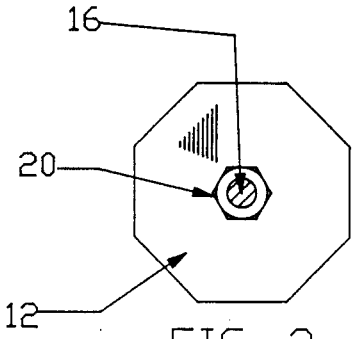
FIG. 3 is a cross-sectional view along line 3—3 of FIG. 2 of the octagon-shaped discs and show the typical nut used to secure a disc rigidly upon the threaded axle.

FIG. 3 provides a cross-sectional view of a typical disc 12, nut 20 and axle 16.

Figure 4:
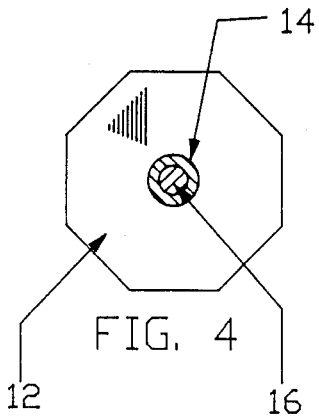
FIG. 4 is a cross-sectional view along line 4—4 of FIG. 2 showing the relation of disc, spacer, and axle.

FIG. 4 shows a cross-sectional view of the relationship of a typical disc 12, spacer 14, and axle 16.

Figure 5:
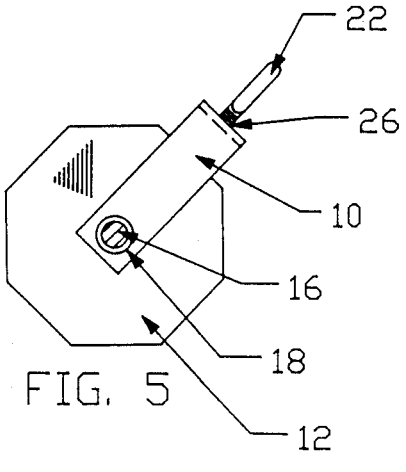
FIG. 5 is an end view along lines 5—5 of FIG. 2 of the frame showing the orifice within which the axle revolves.

FIG. 5 is an end view of the assembly shown in FIG. 2, illustrating in particular eyebolt 22 attached to frame 10 and a typical disc 12 mounted on axle 16. Axle 16 is shown protruding through orifice 18 in one end of frame 10.

The discs can be formed in shapes other than round with significant traction benefits. The octagon-shaped disc includes eight straight sides in its periphery and is the preferred embodiment included here but other multiple straight sided periphery discs could be employed, if desired.

In operation, the tool or apparatus is a rugged self-contained golf ball retrieving tool capable of sustaining the impact with water when cast a considerable distance into a remote area of a water hazard. The tool has no upside or downside position. Without a handle or concern for delicate manipulation, a simple cord 23 attached to an eyelet 22 permits the user to pull the tool at a steady pace through the water hazard. As the tool is pulled, as down pressure is exerted upon the edges of the rotating discs 12 of the retriever tool due to the hydroplaning action of ball-confining frame 10 as it forcibly contacts the water at an angle slightly above parallel to the surface over which it is being pulled. This down pressure plus the weight of the tool provides firm traction upon the bottom of the hazard, thus synergistic rotation of the ball-pinching discs 12 occurs as they roll over the bottom of the water hazard.

Frame 10 is uniquely constructed to provide several functions, such as the hydroplaning action already noted. In addition, there is created a ball-confining area ahead of the rolling discs. The ball-pinching discs are maintained with a frame angle slightly above horizontal when the tool is pulled by the cord by the user, permitting a golf ball to pass under frame 10 so as to contact the rolling, pinching discs 12 first. Any deflection by or from one of discs 12 is redirected by the confining frame 10 back toward discs 12. The disc retaining axle 16 is positioned within frame 10 so that a spaced relationship of approximately one-third the diameter of a golf ball is maintained between the inner side of the intermediate portion of frame 10 and the outer perimeter of discs 12. This spaced relationship aids in securing a ball firmly into a disc retaining space by causing the ball to roll against the inward side of frame 10 rather than striking the frame edge, thereby blocking axle rotation or dislodging the ball.

While a preferred embodiment of the invention has been described and illustrated, it will be understood that the invention is not limited thereto, since many modifications may be made and will become apparent to those skilled in the art.

What is claimed is:

1. Golf ball retrieving apparatus for retrieving golf balls from a water hazard, comprising a one-half rectangular strap frame having parallel ends, an axle connected to each of said ends, a plurality of resilient, ball-pinching discs rigidly secured to said axle, each of said discs having a periphery with multiple straight sides to provide said discs with traction, said discs being spaced along said axle from each other at successive distances slightly less than the diameter of a golf ball, and means attached to said frame for pulling said apparatus by said frame at an angle slightly above horizontal to provide downward pressure on said frame by hydroplaning action and rolling said discs on the bottom of the water hazard such that a golf ball being retrieved passes under said frame and is pinched between adjacent ones of said discs.

2. Golf ball retrieving apparatus in accordance with claim 1, wherein the distance between said frame and the periphery of each of said discs is one-third the diameter of a golf ball.

3. Golf ball retrieving apparatus in accordance with claim 1, wherein said means attached to said frame is a cord attached to said frame half-way between said ends.

* * * * *